US011187396B1

(12) United States Patent
Johnson et al.

(10) Patent No.: US 11,187,396 B1
(45) Date of Patent: Nov. 30, 2021

(54) EXTERIOR LIGHT ASSEMBLY FOR VEHICLE AND METHOD OF USING THE SAME

(71) Applicant: Ford Global Technologies, LLC, Dearborn, MI (US)

(72) Inventors: Aaron Bradley Johnson, Allen Park, MI (US); Luciano Lukacs, Plymouth, MI (US); Stuart C. Salter, White Lake, MI (US); David Brian Glickman, Southfield, MI (US); Paul Kenneth Dellock, Northville, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/361,386

(22) Filed: Jun. 29, 2021

(51) Int. Cl.

| | |
|---|---|
| ***F21S 43/40*** | (2018.01) |
| ***F21S 43/31*** | (2018.01) |
| ***F21S 43/14*** | (2018.01) |
| ***F21S 43/20*** | (2018.01) |
| ***F21W 103/20*** | (2018.01) |
| ***F21W 103/35*** | (2018.01) |
| ***F21W 104/00*** | (2018.01) |

(52) U.S. Cl.
CPC ..... *F21S 43/40* (2018.01); *F21S 43/14* (2018.01); *F21S 43/26* (2018.01); *F21S 43/31* (2018.01); *F21W 2103/20* (2018.01); *F21W 2103/35* (2018.01); *F21W 2104/00* (2018.01)

(58) Field of Classification Search
CPC ..... F21S 43/14; F21S 43/26; F21S 43/30–51; F21W 2103/20; F21W 2103/35; F21W 2104/00
USPC ..... 362/487, 509–522
See application file for complete search history.

(56) References Cited

U.S. PATENT DOCUMENTS

| | | | | |
|---|---|---|---|---|
| 10,132,460 | B1 | 11/2018 | Salter et al. | |
| 2018/0149333 | A1 | 5/2018 | Kumar et al. | |
| 2019/0101734 | A1 | 4/2019 | Measel et al. | |
| 2020/0240610 | A1 | 7/2020 | Thomae et al. | |
| 2021/0180759 | A1* | 6/2021 | Floc'h | F21S 43/245 |

FOREIGN PATENT DOCUMENTS

| | | | |
|---|---|---|---|
| CN | 202947082 | U | 5/2013 |

* cited by examiner

*Primary Examiner* — Jason M Han
(74) *Attorney, Agent, or Firm* — David Coppiellie; Carlson, Gaskey & Olds, P.C.

(57) ABSTRACT

This disclosure relates to an exterior light assembly for a motor vehicle and a method of using the same. An example light assembly includes a light source and a lens arrangement including a near field lens, a reflective plate, and an outer lens. The light assembly further includes a reflector including a first surface configured to reflect light exiting the near field lens toward the reflective plate and further includes a second surface opposite the first surface. The second surface is configured as a decorative surface and is visible from an exterior of the motor vehicle.

20 Claims, 2 Drawing Sheets

EXTERIOR LIGHT ASSEMBLY FOR VEHICLE AND METHOD OF USING THE SAME

TECHNICAL FIELD

This disclosure relates to an exterior light assembly for a motor vehicle and a method of using the same.

BACKGROUND

Motor vehicles are known to include exterior lighting systems including a number of lighting and signaling devices. Such devices include conspicuity lamps which are generally operable increase the visibility of the vehicle, allowing other drivers and pedestrians to see the vehicle's presence and the driver's intentions regarding direction of travel. Vehicles are known to include rear, exterior lighting systems include left and right rear lamps at opposite sides of the vehicle and a center high-mount stop lamp (CHMSL) between the rear lamps. In some systems, the left and right rear lamps are configured to perform multiple signaling functions, including being operable as tail lamps, brake lamps (or, stop lamps), turn signals, and reverse lamps. As such, the left and right rear lamps are sometimes referred to as rear combination lamps.

SUMMARY

A light assembly for a motor vehicle according to an exemplary aspect of the present disclosure includes, among other things, a light source and a lens arrangement including a near field lens, a reflective plate, and an outer lens. The light assembly further includes a reflector including a first surface configured to reflect light exiting the near field lens toward the reflective plate and further includes a second surface opposite the first surface. The second surface is configured as a decorative surface and is visible from an exterior of the motor vehicle.

In a further non-limiting embodiment of the foregoing light assembly, the decorative surface is a bezel at least partially surrounding the outer lens.

In a further non-limiting embodiment of any of the foregoing light assemblies, the decorative surface is a Class A surface.

In a further non-limiting embodiment of any of the foregoing light assemblies, the reflective plate includes a substrate and a metal material on the substrate.

In a further non-limiting embodiment of any of the foregoing light assemblies, the metal material is configured as a plurality of cubes.

In a further non-limiting embodiment of any of the foregoing light assemblies, the metal material is deposited onto acrylic material.

In a further non-limiting embodiment of any of the foregoing light assemblies, a layer of phosphor paint is applied to the metal material.

In a further non-limiting embodiment of any of the foregoing light assemblies, the outer lens includes a first clear side, a second clear side opposite the first clear side, and a laser etched layer between the first and second clear sides.

In a further non-limiting embodiment of any of the foregoing light assemblies, the first clear side is an exterior side and is laser etched.

In a further non-limiting embodiment of any of the foregoing light assemblies, the lens arrangement further includes an inner lens arranged between the reflective plate and the outer lens.

In a further non-limiting embodiment of any of the foregoing light assemblies, the outer lens and the reflector are molded together using a two-shot molding process.

In a further non-limiting embodiment of any of the foregoing light assemblies, the light source is a single light emitting diode (LED) bulb.

In a further non-limiting embodiment of any of the foregoing light assemblies, the light source is multi-colored light emitting diode (LED) configured to selectively illuminate one of a plurality of colors.

In a further non-limiting embodiment of any of the foregoing light assemblies, the light assembly is an exterior light assembly of the motor vehicle.

In a further non-limiting embodiment of any of the foregoing light assemblies, the light assembly is a rear conspicuity lamp.

In a further non-limiting embodiment of any of the foregoing light assemblies, the light assembly is a tail lamp.

A method according to an exemplary aspect of the present disclosure includes, among other things, directing light from a light source to a lens arrangement, the lens arrangement including a near field lens, a reflective plate, and an outer lens. The method further includes reflecting light using a first surface of a reflector such that light exiting the near field lens is directed toward the reflective plate. The reflector includes a second surface opposite the first surface configured as a decorative surface and visible from an exterior of a motor vehicle.

In a further non-limiting embodiment of the foregoing method, the second surface is a class A surface and at least partially surrounds the outer lens.

In a further non-limiting embodiment of any of the foregoing methods, the outer lens and the reflector are molded together using a two-shot molding process.

In a further non-limiting embodiment of any of the foregoing methods, the reflective plate includes a metal material configured as a plurality of cubes.

DETAILED DESCRIPTION

This disclosure relates to an exterior light assembly for a motor vehicle and a method of using the same. An example light assembly includes a light source and a lens arrangement including a near field lens, a reflective plate, and an outer lens. The light assembly further includes a reflector including a first surface configured to reflect light exiting the near field lens toward the reflective plate and further includes a second surface opposite the first surface. The second surface is configured as a decorative surface and is visible from an exterior of the motor vehicle. The light assembly provides bright, uniform light, which appears bright and uniform when the light assembly is viewed from various perspectives, including side perspectives. The light assembly is also relatively lightweight and easy to manufacture. Further, the light assembly includes a readily replaceable light source, and thus the useful life of the light assembly can be extended by merely replacing the light source as opposed to replacing the entire assembly. These and other benefits will be appreciated from the below description.

Figure 1:
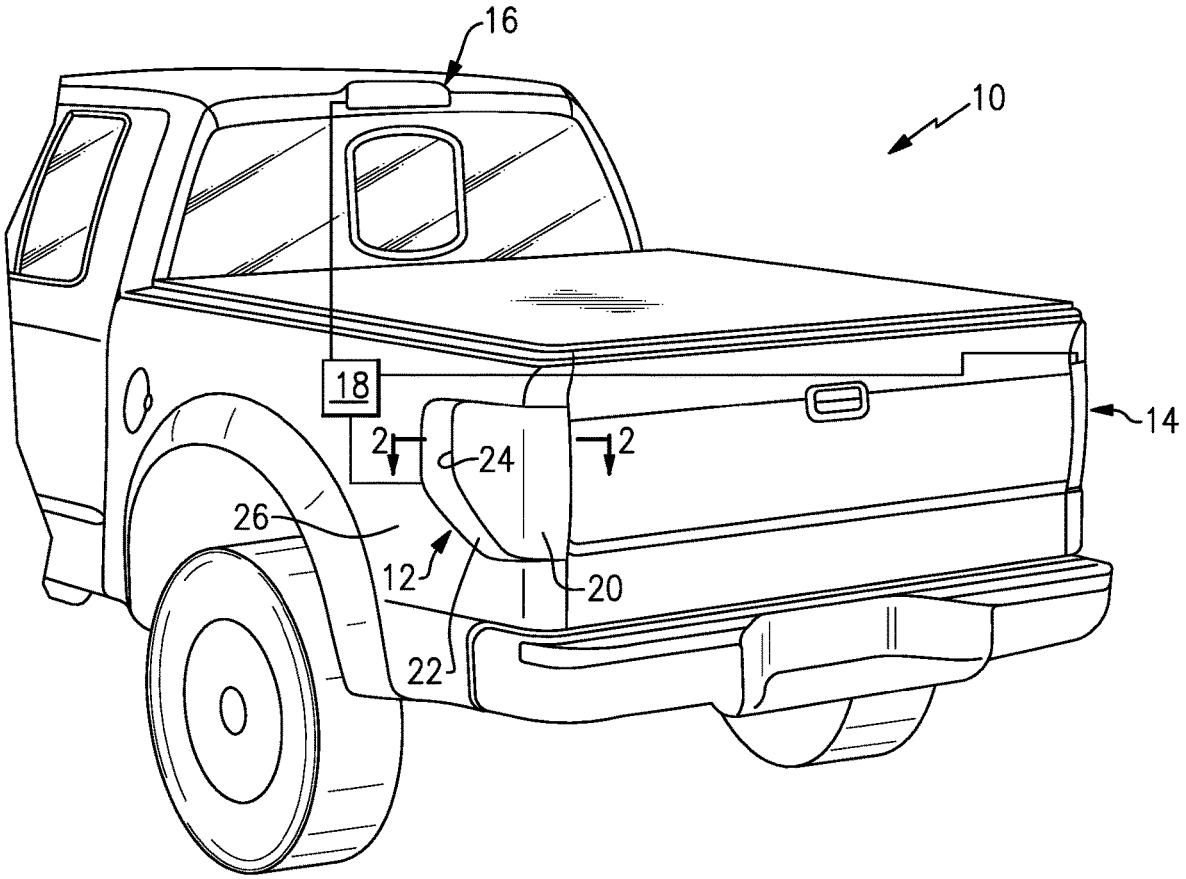
FIG. 1 is a rear-perspective view of a motor vehicle with an example exterior light assembly.

Referring to the drawings, FIG. 1 is a rear-perspective view of a motor vehicle 10. As shown, the vehicle 10 is a truck. While a truck is pictured, this disclosure is not limited to any particular vehicle type, and extends to cars, vans, sport utility vehicles (SUVs), etc.

The vehicle 10 includes a plurality of conspicuity lamps, in this example. Conspicuity lamps are lamps that make a vehicle conspicuous and visible with respect to its presence, position, direction of travel, change in direction, etc. Among other conspicuity lamps, the vehicle 10 includes a first rear lamp 12, a second rear lamp 14, and a center high-mount stop lamp 16 (CHMSL). The first and second rear lamps 12, 14 may be referred to as tail lamps.

In an example, the first rear lamp 12 is a left tail lamp because it is arranged adjacent the left side of the vehicle 10, and the second rear lamp 14 is a right tail lamp because it is arranged adjacent the right side of the vehicle 10, when viewed from a rear of the vehicle 10. The first and second rear lamps 12, 14 may be combination lamps. In that case, the first and second rear lamps 12, 14 are configured to emit different colors of light to signal different vehicle operations.

The first and second rear lamps 12, 14 and the CHMSL 16 are electrically coupled to a controller 18. The controller 18 is shown schematically in FIG. 1. It should be understood that the controller 18 could be part of an overall vehicle control module, such as a vehicle system controller (VSC), or may be part of a body control module (BCM). Alternatively, the controller 18 may be a stand-alone controller separate from the VSC and the BCM. Further, the controller 18 may be programmed with executable instructions for interfacing with and operating the various components of the vehicle 10. The controller 18 additionally includes hardware and software, and further includes a processing unit and non-transitory memory for executing the various control strategies and modes of the vehicle system.

Among other functions, the controller 18 is configured to selectively illuminate the first and second rear lamps 12, 14 and the CHMSL 16. In particular, the controller 18 may be configured to issue instructions to the lights associated with the first and second rear lamps 12, 14 and the CHMSL 16 to illuminate the first and second rear lamps 12, 14 and the CHMSL 16 one of a plurality of colors.

The first and second rear lamps 12, 14 and the CHMSL 16 are each, separately, considered exterior light assemblies, and each of these assemblies is rear-facing. While the vehicle 10 includes three rear-facing exterior light assemblies, this disclosure extends to vehicles with a different number of exterior, rear-facing light assemblies. This disclosure also applies to light assemblies which are not rear-facing, such as side-facing and front-facing light assemblies.

With reference to the first rear lamp 12, from an exterior perspective the first rear lamp 12 includes a lighting section 20 configured to emit light. The lighting section 20 is partially surrounded, in this example, by a bezel 22. The bezel 22 is a frame which surrounds at least a portion of the perimeter 24 of the lighting section 20. The bezel 22 does not emit light and instead provides a decorative surface which smoothly transitions between the lighting section 20 and an adjacent body panel 26 of the vehicle 10. Here, the body panel 26 is a bedside panel.

The exterior surface of the bezel 22 is a Class A surface, in this example. A Class A surface is known in the automotive art field as a surface with continuous curvature and without any perceptible waves such that the surface is visually decorative and smooth to the unaided eye or, in other words, is visually free of unintentional distortions, such as 'sink marks,' dimples, indents, divots, or the like. The exterior surface of the bezel 22 may be metallized, meaning it is coated with a thin layer of metallic material, or may be painted, while remaining a Class A surface.

Figure 2:
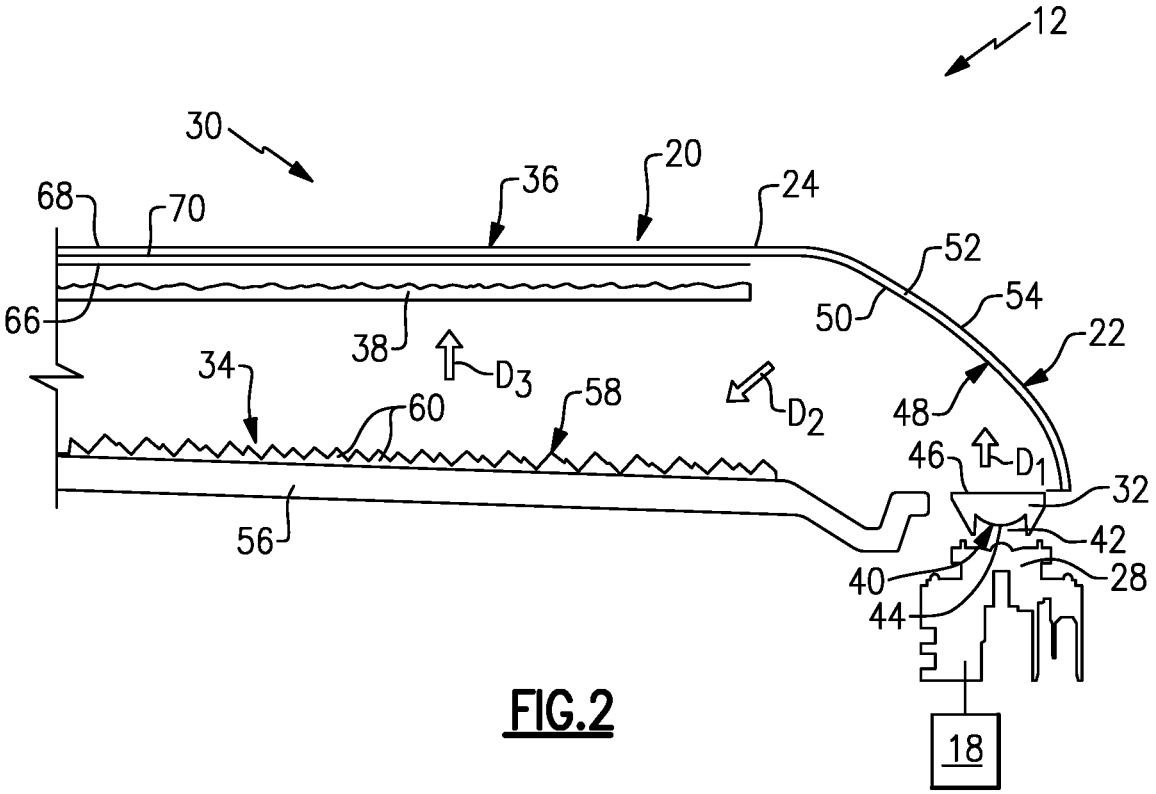
FIG. 2 is a cross-sectional view taken along line 2-2 and illustrates an example exterior light assembly.

FIG. 2 is a cross-sectional view of the first rear lamp 12, and in particular illustrates an exemplary arrangement of components of the first rear lamp 12. It should be understood that the arrangement of components in FIG. 2 could be applied to the second rear lamp 14, the CHMSL 16, and/or any other exterior light assembly of the vehicle 10.

The first rear lamp 12 includes a light source 28 configured to emit light. The light source 28 is a light emitting diode (LED) in one example. In a particular example, the light source 28 is an LED bulb. In some embodiments, the light source 28 is a multi-color LED configured to selectively illuminate one of a plurality of colors. In particular, in response to instructions from the controller 18, the light source 28 may be configured to illuminate a red color, an amber color, or a white color.

The first rear lamp 12 further includes a lens arrangement 30 including a plurality of components. In this example, the lens arrangement 30 includes a near field lens 32, a reflective plate 34, and an outer lens 36. In this example, the lens arrangement 30 further includes an optional inner lens 38. Each component will now be described in more detail.

The near field lens 32, in this example, is arranged adjacent the light source 28. The near field lens 32 includes an inner surface 40 which defines a recess 42. The light source 28 is at least partially aligned with the recess 42. The inner surface 40 includes a convex surface 44, as viewed from the perspective of the light source 28. Opposite the inner surface 40, the near field lens 32 includes an outer surface 46, which is a planar, flat surface. In particular, in this example, the entirety of the outer surface 46 is a planar, flat surface. The outer surface 46 is substantially parallel to the outer lens 36. The outer surface 46 directs light in a direction $D_1$ toward a reflector 48.

The reflector 48, in this example, is provided by a structure which also provides the bezel 22. Specifically, the reflector 48 is provided by a first surface 50 of a structure 52. The structure 52 is a single-walled structure, such as a metal or plastic structure, which may be painted or metallized, as examples. The structure 52 may be referred to as the reflector 48 or the bezel 22, since the structure 52 serves as both the reflector 48 and the bezel 22. Because the structure 52 serves a dual purpose, the first rear lamp 12 is lighter and less costly than known designs. The first surface 50 includes a reflective material such that light emitted from the near field lens 32 is reflected toward the reflective plate 34. In an example, the first surface 50 is metallized with a reflective metal, in this example. A second surface 54 of the structure 52 opposite the first surface 50 is visible from the exterior of the vehicle 10 and provides the bezel 22. The second surface 54 is the Class A surface discussed above. The second surface 54 can be painted or metallized.

The reflector 48 is configured to direct light generally in direction $D_2$ toward the reflective plate 34. The reflective plate 34 is configured such that no light passes through the reflective plate 34, and such that all light is reflected off the reflective plate 34 in the direction $D_3$ toward the outer lens 36.

In this example, the reflective plate 34 includes a substrate 56 and a metal material 58 on the substrate 56. The substrate may be metallized to provide the metal material 58. The metal material 58 is a thin layer of metal on a side of the substrate 56 facing the outer lens 36. The reflective plate 34 is sized and shaped to correspond to the overall size and shape of the lighting section 20 of the first rear lamp 12. In this manner, the reflective plate 34 fully and completely illuminates the entire lighting section 20.

The metal material 58 is configured as a plurality of cube-like shapes 60. The cube-like shapes 60 may be formed using a die, as an example. The cube-like shapes 60 each including a plurality of planar surfaces projecting from the substrate 56 toward the outer lens 36. In an example, each of the cube-like shapes 60 is a partial cube.

Figure 3:
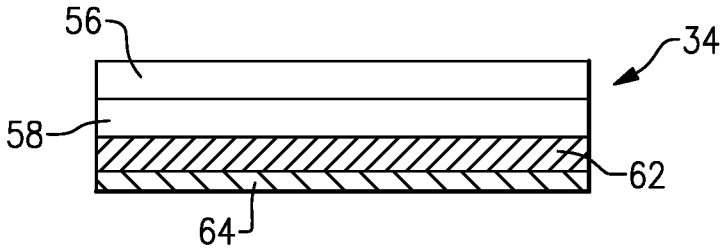
FIG. 3 is a cross-sectional view of an example reflective plate.

The reflective plate 34 may include one or more layers of material on the metal material 58. With reference to FIG. 3, the substrate 56 may be an acrylic material. The metal material 58 may be deposited on the substrate 56 and, using a die, formed into the cube-like shapes 60. A layer of phosphor paint 62 may be applied to the metal material 58. The phosphor may be a long persistence phosphor, in one example. The layer of phosphor paint 62 is optional.

Further, a layer of reflective material 64 may be applied to the layer of phosphor paint 62. The layer of reflective material 64 may be provided by a layer of partial vacuum metallized material. The layer of reflective material 64 is optional. When used in combination with the layer of phosphor paint 62, the layer of reflective material 64 improves the performance of the layer of phosphor paint 62.

The outer lens 36, in this example, includes three layers, a first side 66 facing toward the reflective layer 34, a second side 68 facing the exterior of the vehicle 10, and a laser etched layer 70 between the first and second sides 66, 68. The outer lens 36 is viewed as the lighting section 20 from the exterior of the vehicle 10. The first and second sides 66, 68 are made of a clear material, such as a clear plastic. The clear plastic can be colored such that it exhibits a red or amber tint, in examples. The laser etched layer 70 is laser etched such that the laser etched layer 70 collimates light passing through the laser etched layer 70.

The outer lens 36 is molded together with the bezel 22, in this example. In an example, the outer lens 36 is made of a polycarbonate material and the bezel 22 is also made of a polycarbonate material. The outer lens 36 and bezel 22 may be molded together using a two-shot mold process or an overmolding process, as examples. The outer lens 36 is molded with the bezel 22 such that the second side 68 provides a seamless transition to the bezel 22 such that the perimeter 24 does not exhibit any seams, gaps, or bumps.

The lens arrangement 30 may, in some examples, include an inner lens 38, which acts as a diffuser, between the reflective plate 34 and the outer lens 36. The inner lens 38 is a lens which may lessen the intensity of the light reflected by the reflective plate 34, and may be useful in some examples.

The lens arrangement 30 of the present disclosure provides bright, uniform light over the entire lighting surface 20 using a single light source 28. The light source 28 is readily replaceable. Since there is only one light source 28 for the first rear lamp 12, excess heat is not created. Further, the weight of the vehicle 10 is reduced.

It should be understood that terms such as "about," "substantially," and "generally" are not intended to be boundaryless terms, and should be interpreted consistent with the way one skilled in the art would interpret those terms.

Although the different examples have the specific components shown in the illustrations, embodiments of this disclosure are not limited to those particular combinations. It is possible to use some of the components or features from one of the examples in combination with features or components from another one of the examples. In addition, the various figures accompanying this disclosure are not necessarily to scale, and some features may be exaggerated or minimized to show certain details of a particular component or arrangement.

One of ordinary skill in this art would understand that the above-described embodiments are exemplary and non-limiting. That is, modifications of this disclosure would come within the scope of the claims. Accordingly, the following claims should be studied to determine their true scope and content.

The invention claimed is:

1. A light assembly for a motor vehicle, comprising:

a light source;

a lens arrangement including a near field lens, a reflective plate, and an outer lens; and a reflector including a first surface configured to reflect light exiting the near field lens toward the reflective plate, and further including a second surface opposite the first surface, wherein the second surface is configured as a decorative surface and is visible from an exterior of the motor vehicle.

2. The light assembly as recited in claim 1, wherein the decorative surface is a bezel at least partially surrounding the outer lens.

3. The light assembly as recited in claim 1, wherein the decorative surface is a Class A surface.

4. The light assembly as recited in claim 1, wherein the reflective plate includes a substrate and a metal material on the substrate.

5. The light assembly as recited in claim 4, wherein the metal material is configured as a plurality of cubes.

6. The light assembly as recited in claim 5, wherein the metal material is deposited onto acrylic material.

7. The light assembly as recited in claim 6, wherein a layer of phosphor paint is applied to the metal material.

8. The light assembly as recited in claim 1, wherein the outer lens includes a first clear side, a second clear side opposite the first clear side, and a laser etched layer between the first and second clear sides.

9. The light assembly as recited in claim 8, wherein the first clear side is an exterior side and is laser etched.

10. The light assembly as recited in claim 8, wherein the lens arrangement further includes an inner lens arranged between the reflective plate and the outer lens.

11. The light assembly as recited in claim 8, wherein the outer lens and the reflector are molded together using a two-shot molding process.

12. The light assembly as recited in claim 1, wherein the light source is a single light emitting diode (LED) bulb.

13. The light assembly as recited in claim 1, wherein the light source is multi-colored light emitting diode (LED) configured to selectively illuminate one of a plurality of colors.

14. The light assembly as recited in claim 1, wherein the light assembly is an exterior light assembly of the motor vehicle.

15. The light assembly as recited in claim 14, wherein the light assembly is a rear conspicuity lamp.

16. The light assembly as recited in claim 15, wherein the light assembly is a tail lamp.

17. A method, comprising:

directing light from a light source to a lens arrangement, the lens arrangement including a near field lens, a reflective plate, and an outer lens; and reflecting light using a first surface of a reflector such that light exiting the near field lens is directed toward the reflective plate, wherein the reflector includes a second surface opposite the first surface configured as a decorative surface and visible from an exterior of a motor vehicle.

18. The method as recited in claim 17, wherein the second surface is a class A surface and at least partially surrounds the outer lens.

19. The method as recited in claim 17, wherein the outer lens and the reflector are molded together using a two-shot molding process.

20. The method as recited in claim 17, wherein the reflective plate includes a metal material configured as a plurality of cubes.

* * * * *